US009991033B2

(12) United States Patent
Taihaku et al.

(10) Patent No.: US 9,991,033 B2
(45) **Date of Patent: *Jun. 5, 2018**

(54) RARE-EARTH PERMANENT MAGNET AND METHOD FOR MANUFACTURING RARE-EARTH PERMANENT MAGNET

(71) Applicant: NITTO DENKO CORPORATION, Ibaraki-shi, Osaka (JP)

(72) Inventors: Keisuke Taihaku, Ibaraki (JP); Katsuya Kume, Ibaraki (JP); Toshiaki Okuno, Ibaraki (JP); Izumi Ozeki, Ibaraki (JP); Tomohiro Omure, Ibaraki (JP); Takashi Ozaki, Ibaraki (JP)

(73) Assignee: NITTO DENKO CORPORATION, Ibaraki-shi, Osaka (JP)

( * ) Notice: Subject to any disclaimer, the term of this patent is extended or adjusted under 35 U.S.C. 154(b) by 159 days.

This patent is subject to a terminal disclaimer.

(21) Appl. No.: 15/007,318

(22) Filed: Jan. 27, 2016

(65) Prior Publication Data

US 2016/0141100 A1 May 19, 2016

Related U.S. Application Data

(63) Continuation of application No. 13/816,344, filed as application No. PCT/JP2012/056701 on Mar. 15, 2012, now Pat. No. 9,281,107.

(30) Foreign Application Priority Data

Jun. 24, 2011 (JP) ..... 2011-140909
Jun. 24, 2011 (JP) ..... 2011-140913

(51) Int. Cl.
*H01F 1/053* (2006.01)
*B22F 1/02* (2006.01)
(Continued)

(52) U.S. Cl.
CPC ..... *H01F 1/0536* (2013.01); *B22F 1/0062* (2013.01); *B22F 1/02* (2013.01);
(Continued)

(58) Field of Classification Search
CPC .. H01F 1/0536; H01F 41/0266; B22F 3/1021; B22F 3/16; B22F 2001/0066;
(Continued)

(56) References Cited

U.S. PATENT DOCUMENTS 5,427,734 A 6/1995 Yamashita et al.
6,361,738 B1 3/2002 Kaneko et al.
(Continued)

FOREIGN PATENT DOCUMENTS

EP 0 576 282 A2 12/1993
JP 62-282417 A 12/1987
(Continued)

OTHER PUBLICATIONS

Communication dated Apr. 28, 2014 from the Taiwanese Intellectual Property Office in counterpart Taiwan Patent Application No. 101109955.
(Continued)

*Primary Examiner* — C Melissa Koslow
(74) *Attorney, Agent, or Firm* — Sughrue Mion, PLLC

(57) ABSTRACT

There are provided a rare-earth permanent magnet and a manufacturing method thereof capable of preventing deterioration of magnet properties. In the method, magnet material is milled into magnet powder. Next, a mixture is prepared by mixing the magnet powder and a binder made of long-chain hydrocarbon and/or of a polymer or a copolymer consisting of monomers having no oxygen atoms. Next, the mixture is formed into a sheet-like shape so as to obtain a green sheet. After that, the green sheet is held for a predetermined length of time at binder decomposition tem-
(Continued)

perature in a non-oxidizing atmosphere so as to remove the binder by causing depolymerization reaction or the like to the binder, which turns into monomer. The green sheet from which the binder has been removed is sintered by raising temperature up to sintering temperature. Thereby a permanent magnet 1 is obtained.

3 Claims, 3 Drawing Sheets

(51) Int. Cl.

| | |
|---|---|
| ***B22F 3/02*** | (2006.01) |
| ***B22F 3/10*** | (2006.01) |
| ***H01F 41/02*** | (2006.01) |
| ***H01F 1/42*** | (2006.01) |
| ***C22C 38/00*** | (2006.01) |
| ***B22F 1/00*** | (2006.01) |
| ***B22F 5/00*** | (2006.01) |
| ***B22F 3/16*** | (2006.01) |
| ***H01F 1/06*** | (2006.01) |
| *B22F 3/24* | (2006.01) |

(52) U.S. Cl.
CPC ..... *B22F 3/02* (2013.01); *B22F 3/1021* (2013.01); *B22F 3/16* (2013.01); *B22F 5/006* (2013.01); *C22C 38/002* (2013.01); *C22C 38/005* (2013.01); *H01F 1/06* (2013.01); *H01F 1/42* (2013.01); *H01F 41/0266* (2013.01); *B22F 2001/0066* (2013.01); *B22F 2003/248* (2013.01); *B22F 2201/01* (2013.01); *B22F 2301/45* (2013.01); *B22F 2302/45* (2013.01); *B22F 2998/10* (2013.01); *B22F 2999/00* (2013.01); *C22C 2202/02* (2013.01)

(58) Field of Classification Search
CPC ..... B22F 2003/145; B22F 2201/01; B22F 2003/013; B22F 5/0006; B22F 2301/45; B22F 2998/16
See application file for complete search history.

(56) References Cited

U.S. PATENT DOCUMENTS

| | | | | |
|---|---|---|---|---|
| 9,281,107 | B2 * | 3/2016 | Taihaku ..... | B22F 1/02 |
| 2009/0053094 | A1 | 2/2009 | Morimoto et al. | |
| 2011/0037548 | A1 | 2/2011 | Ozeki et al. | |
| 2011/0121498 | A1 | 5/2011 | Irie et al. | |

FOREIGN PATENT DOCUMENTS

| | | | |
|---|---|---|---|
| JP | 1-50303 | A | 6/1989 |
| JP | 5-320708 | A | 12/1993 |
| JP | 6-116605 | A | 4/1994 |
| JP | 9-283358 | A | 10/1997 |
| JP | 2000-306753 | A | 11/2000 |
| JP | 2001-006958 | A | 1/2001 |
| JP | 2003-313602 | A | 11/2003 |
| JP | 4364487 | B | 2/2004 |
| JP | 2004-146713 | A | 5/2004 |
| JP | 2005-203555 | A | 7/2005 |
| JP | 2007-134417 | A | 5/2007 |
| JP | 2009-259955 | A | 11/2009 |

OTHER PUBLICATIONS

Extended European Search Report dated Mar. 16, 2015 from the European Patent Office in counterpart application No. 12803430.3.
Notification of the first Office Action dated Nov. 9, 2015, from the State Intellectual Property Office of People's Republic of China in counterpart Application No. 201280002740.8.
Decision of Refusal issued in JP Application No. 2012-058074, dated Jun. 4, 2013.
International Search Report for PCT/JP2012/056701 dated Jun. 12, 2012.
Japanese Office Action issued in corresponding JP Application No. 2012058073 dated Feb. 5, 2013.
Japanese Office Action issued in corresponding JP Application No. 2012058074 dated Feb. 5, 2013.
Office Action for JP 2012-058073, which claims priority from JP 2011-140909, dated Sep. 25, 2012.
Office Action for JP 2012-058074, which claims priority from JP 2011-140913, dated Sep. 25, 2012.
Notification of Second Office Action dated Jun. 28, 2016, from the State Intellectual Property Office of the P.R.C., in counterpart Chinese application No. 201280002740.8.
Decision of Refusal issued in JP Application No. 2012-058073, dated Jun. 4, 2013.
Examination Report dated Dec. 26, 2017, issued by the Indian Patent Office in counterpart Application No. 514/CHENP/2013.
Notification of First Office Action dated Feb. 28, 2018 from the Korean Intellectual Property Office in counterpart application No. 10-2013-7003373.

* cited by examiner

FIG. 3

| | | BINDER | OXYGEN CONCEN-TRATION [ppm] | CARBON CONCEN-TRATION [ppm] | FORM-ABILITY | RESIDUAL MAGNETIC FLUX DENSITY Br [kG] | COERCIVE FORCE Hcj [kOe] |
|---|---|---|---|---|---|---|---|
| EMBODIMENT | 1 | POLYISOBUTYLENE | 1500 | 400 | GOOD | 11 | 13 |
| | 2 | POLYISOPRENE(IR) | 1500 | 1500 | GOOD | 10 | 12 |
| | 3 | POLYBUTADIENE(BR) | 1500 | 800 | GOOD | 10.5 | 12.5 |
| | 4 | POLYSTYRENE | 1500 | 700 | GOOD | 10.5 | 12.5 |
| | 5 | STYRENE-ISOPRENE COPOLYMER (SIS) | 1500 | 300 | GOOD | 11 | 13 |
| | 6 | ISOBUTYLENE-ISOPRENE COPOLYMER (IIR) | 1500 | 350 | GOOD | 11 | 13 |
| | 7 | STYRENE-BUTADIENE COPOLYMER (SBS) | 1500 | 500 | GOOD | 11 | 13 |
| | 8 | POLY(2-METHYL-1-PENTENE) | 1500 | 400 | GOOD | 11 | 13 |
| | 9 | POLY(2-METHYL-1-BUTENE) | 1500 | 400 | GOOD | 11 | 13 |
| | 10 | POLY(ALPHA-METHYLSTYRENE) | 1500 | 400 | GOOD | 11 | 13 |
| | 11 | OCTACOSANE | 1500 | 400 | GOOD | 11 | 13 |
| COMPARATIVE EXAMPLE | 1 | POLYBUTYLMETHACRYLATE | 9000 | 500 | GOOD | 5.5 | 7 |
| | 2 | POLYMETHYLMETHACRYLATE | 9000 | 400 | GOOD | 5.5 | 7 |
| | 3 | POLYETHYLENE | --- | --- | NO GOOD | --- | --- |
| | 4 | POLYPROPYLENE | --- | --- | NO GOOD | --- | --- |
| | 5 | POLYISOBUTYLENE (NOT CALCINED IN $H_2$) | 1150 | 3950 | GOOD | 7 | 1 |

RARE-EARTH PERMANENT MAGNET AND METHOD FOR MANUFACTURING RARE-EARTH PERMANENT MAGNET

This is a continuation of U.S. application Ser. No. 13/816,344 filed Feb. 11, 2013, now U.S. Pat. No. 9,281,107, which is a National Stage of International Application No. PCT/JP2012/056701 filed Mar. 15, 2012, claiming priority based on Japanese Patent Application Nos. 2011-140909 filed Jun. 24, 2011 and 2011-140913 filed Jun. 24, 2011; the contents of all of which are incorporated herein by reference in their entirety.

TECHNICAL FIELD

The present invention relates to a rare-earth permanent magnet and a manufacturing method of the rare-earth permanent magnet.

BACKGROUND ART

In recent years, a decrease in size and weight, an increase in power output and an increase in efficiency have been required in a permanent magnet motor used in a hybrid car, a hard disk drive, or the like. To realize such a decrease in size and weight, an increase in power output and an increase in efficiency in the permanent magnet motor mentioned above, film-thinning and a further improvement in magnetic performance have been required of a permanent magnet to be buried in the permanent magnet motor.

Here, as a method for manufacturing the permanent magnet used in the permanent magnet motor, a powder sintering method is generally used. In the powder sintering method as used herein, a raw material is first pulverized with a jet mill (dry-milling) to produce a magnet powder. Thereafter, the magnet powder is placed in a mold, and press molded to a desired shape while a magnetic field is applied from the outside. Then, the solid magnet powder molded into the desired shape is sintered at a predetermined temperature (for example, 1100 degrees Celsius in a case of an Nd—Fe—B-based magnet), thereby manufacturing the permanent magnet.

However, when the permanent magnet is manufactured by the above-mentioned powder sintering method, there have been the following problems. That is to say, in the powder sintering method, it is necessary to secure a predetermined porosity in a press-molded magnet powder in order to perform magnetic field orientation. If the magnet powder having the predetermined porosity is sintered, it is difficult to uniformly contract at the time of sintering. Accordingly deformations such as warpage and depressions occur after sintering. Further, since pressure unevenness occurs at the time of pressing the magnet powder, the magnet is formed to have inhomogeneous density after sintering to generate distortion on a surface of the magnet. Conventionally, it has therefore been required to compression-mold the magnet powder to a larger size than that of a desired shape, assuming that the surface of the magnet has some distortion. Then, diamond cutting and polishing operations have been performed after sintering, for alteration to the desired shape. As a result, the number of manufacturing processes increases, and there also is a possibility of deteriorating qualities of the permanent magnet manufactured.

Specifically, when a thin-film magnet is cut out of a bulk body having a larger size as discussed above, material yield is significantly decreased. Further, a problem of large increase in man-hours has also been raised.

Therefore, as a means for solving the above problems, there has been proposed a method of manufacturing a permanent magnet through kneading a magnet powder and a binder, preparing a green sheet, and sintering the green sheet thus prepared (for instance, Japanese Laid-open Patent Application Publication No. 1-150303).

PRIOR ART DOCUMENT

Patent Document

Patent document 1: Japanese Laid-open Patent Application Publication No. 1-150303 (pages 3 and 4)

DISCLOSURE OF THE INVENTION

Problem to be Solved by the Invention

However, if the magnet powder is formed into the green sheet and then sintered as described in Patent Document 1, substances containing carbon atoms or oxygen atoms included in the binder are likely to remain in the magnet. Since Nd and carbons in the Nd-based magnet exhibit significantly high reactivity therebetween, carbon-containing substances form carbide when remaining up to high-temperature stage in a sintering process. Consequently, the carbide thus formed makes a gap between a main phase and a grain boundary phase of the sintered magnet and accordingly the entirety of the magnet cannot be sintered densely, which causes a problem of serious degradation in the magnetic performance. Even if the gap is not formed, the secondarily-formed carbide makes alpha iron separated out in the main phase of the sintered magnet, which causes a problem of serious degradation in the magnetic properties.

Similarly, as Nd in the Nd-based magnet has high reactivity with oxygen, the presence of oxygen-containing substances causes Nd to bind with the oxygen to form a metal oxide at a sintering process. As a result, there occurs a problem of decrease of magnetic properties. Furthermore, binding of Nd with oxygen makes the Nd content deficient, compared with the content based on the stoichiometric composition (for instance, $Nd_2Fe_{14}B$). Consequently, alpha iron separates out in the main phase of the sintered magnet, which causes a problem of serious degradation in the magnetic properties.

The present invention has been made to resolve the above described conventional problems and the object thereof is to provide a rare-earth permanent magnet and manufacturing method thereof capable of previously reducing carbon content contained in the magnet when magnet powder is made into a green sheet and then sintered, so that degradation of the magnetic properties can be prevented.

Means for Solving the Problem

To achieve the above object, the present invention provides a rare-earth permanent magnet manufactured through steps of: milling magnet material into magnet powder; preparing a mixture by mixing the magnet powder with a binder made of long-chain hydrocarbon and/or of a polymer or a copolymer consisting of monomers containing no oxygen atoms; obtaining a green sheet by forming the mixture in a sheet-like shape; decomposing and removing the binder from the green sheet by holding the green sheet for a predetermined length of time at binder decomposition temperature in a non-oxidizing atmosphere; and sintering the green sheet from which the binder has been removed by raising temperature up to sintering temperature.

In the above-described rare-earth permanent magnet of the present invention, the binder is any one of: polyisobutylene; polyisoprene; polybutadiene; polystyrene; a styrene-isoprene copolymer; an isobutylene-isoprene copolymer; or a styrene-butadiene copolymer.

In the above-described rare-earth permanent magnet of the present invention, the binder is resin other than polyethylene resin and polypropylene resin.

In the above-described rare-earth permanent magnet of the present invention, in the step of decomposing and removing the binder, the green sheet is held for the predetermined length of time in a temperature range of 200 degrees Celsius to 900 degrees Celsius in a hydrogen atmosphere or a mixed gas atmosphere of hydrogen and inert gas.

To achieve the above object, the present invention provides a manufacturing method of a rare-earth permanent magnet comprising the steps of: milling magnet material into magnet powder; preparing a mixture by mixing the magnet powder with a binder made of a long-chain hydrocarbon and/or of a polymer or a copolymer consisting of monomers containing no oxygen atoms; obtaining a green sheet by forming the mixture in a sheet-like shape; decomposing and removing the binder from the green sheet by holding the green sheet for a predetermined length of time at binder decomposition temperature in a non-oxidizing atmosphere; and sintering the green sheet from which the binder has been removed by raising temperature up to sintering temperature.

In the above-described manufacturing method of a rare-earth permanent magnet of the present invention, the binder is any one of: polyisobutylene; polyisoprene; polybutadiene; polystyrene; a styrene-isoprene copolymer; an isobutylene-isoprene copolymer; or a styrene-butadiene copolymer.

In the above-described manufacturing method of a rare-earth permanent magnet of the present invention, the binder is resin other than polyethylene resin and polypropylene resin.

In the above-described manufacturing method of a rare-earth permanent magnet of the present invention, in the step of decomposing and removing the binder, the green sheet is held for the predetermined length of time in a temperature range of 200 degrees Celsius to 900 degrees Celsius in a hydrogen atmosphere or a mixed gas atmosphere of hydrogen and inert gas.

Effect of the Invention

According to the rare-earth permanent magnet of the present invention, the rare-earth permanent magnet is a sintered magnet made from a green sheet obtained by mixing magnet powder and a binder and forming the mixture into a sheet-like shape. Therefore, the thus sintered green sheet uniformly contracts and deformations such as warpage and depressions do not occur to the sintered green sheet. Further, the sintered green sheet having uniformly contracted gets pressed uniformly, which eliminates adjustment process to be conventionally performed after sintering and simplifies manufacturing process. Thereby, a permanent magnet can be manufactured with dimensional accuracy. Further, even if such permanent magnets are manufactured with thinner design, increase in the number of manufacturing processes can be avoided without lowering a material yield. Further, oxygen content remaining in the sintered magnet can be reduced by using a binder made of long-chain hydrocarbon and/or of a polymer or a copolymer consisting of monomers containing no oxygen atoms. Further, magnet powder to which the binder has been added is calcined for a predetermined length of time under a non-oxidizing atmosphere before sintering, whereby carbon content in the permanent magnet can be reduced previously. Consequently, previous reduction of carbon can prevent alpha iron from separating out in a main phase of the sintered magnet and the entirety of the magnet can be sintered densely. Thereby, decrease in the coercive force can be prevented.

Further, according to the rare-earth permanent magnet of the present invention, oxygen content in the sintered magnet can be reduced by using binders containing no oxygen atoms, such as polyisobutylene, polyisoprene, polybutadiene, polystyrene, a styrene-isoprene copolymer, an isobutylene-isoprene copolymer and a styrene-butadiene copolymer.

Further, according to the rare-earth permanent magnet of the present invention, the binder is dissolved in an organic solvent. Particularly, the binder can get properly dissolved in a general purpose solvent such as toluene. Consequently, a green sheet can be formed properly from slurry containing any of the above binders.

Further, according to the rare-earth permanent magnet of the present invention, in the calcination process, the green sheet to which the binder has been mixed is calcined in a hydrogen atmosphere or a mixed gas atmosphere of hydrogen and inert gas. Thereby, carbon content in the magnet can be reduced reliably.

According to the manufacturing method of a rare-earth permanent magnet of the present invention, the rare-earth permanent magnet is a sintered magnet made of a green sheet obtained by mixing magnet powder and a binder and forming the mixture into a sheet-like shape. Therefore, the thus sintered green sheet uniformly contracts and deformations such as warpage and depressions do not occur to the sintered green sheet. Further, the sintered green sheet having uniformly contracted gets pressed uniformly, which eliminates adjustment process to be conventionally performed after sintering and simplifies manufacturing process. Thereby, a permanent magnet can be manufactured with dimensional accuracy. Further, even if such permanent magnets are manufactured with thinner design, increase in the number of manufacturing processes can be avoided without lowering material yield. Further, oxygen content remaining in the sintered magnet can be reduced by using a binder made of long-chain hydrocarbon and/or of a polymer or a copolymer consisting of monomers containing no oxygen atoms. Further, magnet powder to which the binder has been added is calcined for predetermined length of time under non-oxidizing atmosphere before sintering, whereby carbon content in the permanent magnet can be reduced previously. Consequently, previous reduction of carbon can prevent alpha iron from separating out in a main phase of the sintered magnet and the entirety of the magnet can be sintered densely. Thereby, decrease in the coercive force can be prevented.

Further, according to the manufacturing method of a rare-earth permanent magnet of the present invention, oxygen content in the sintered magnet can be reduced by using binders containing no oxygen atoms, such as polyisobutylene, polyisoprene, polybutadiene, polystyrene, a styrene-isoprene copolymer, an isobutylene-isoprene copolymer and a styrene-butadiene copolymer.

Further, according to the manufacturing method of a rare-earth permanent magnet of the present invention, the binder is dissolved in an organic solvent. Particularly, the binder can get properly dissolved in a general purpose solvent such as toluene. Consequently, a green sheet can be formed properly from slurry containing any of the above binders.

Further, according to the manufacturing method of a rare-earth permanent magnet of the present invention, in the calcination process, the green sheet to which the binder has been mixed is calcined in a hydrogen atmosphere or a mixed gas atmosphere of hydrogen and inert gas. Thereby, carbon content in the magnet can be reduced reliably.

BRIEF DESCRIPTION OF THE DRAWINGS

FIG. 3 is a table illustrating various measurement results of magnets according to embodiments and comparative examples, respectively.

BEST MODE FOR CARRYING OUT THE INVENTION

A specific embodiment of a rare-earth permanent magnet and a method for manufacturing the rare-earth permanent magnet according to the present invention will be described below in detail with reference to the drawings.

[Constitution of Permanent Magnet]

Figure 1:
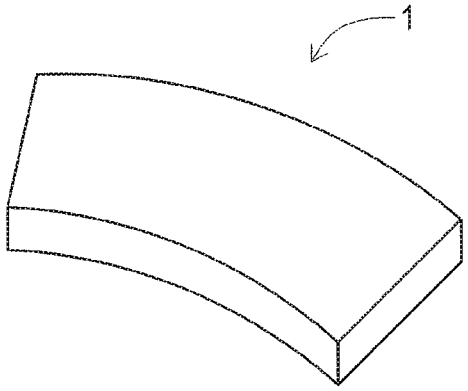
FIG. 1 is an overall view of a permanent magnet according to the invention.

First, a constitution of a permanent magnet 1 according to the present invention will be described. FIG. 1 is an overall view of the permanent magnet 1 according to the present invention. Incidentally, the permanent magnet 1 depicted in FIG. 1 has a fan-like shape; however, the shape of the permanent magnet 1 may be changed according to the shape of a cutting-die.

As the permanent magnet 1 according to the present invention, an Nd—Fe—B-based magnet may be used. Incidentally, the contents of respective components are regarded as Nd: 27 to 40 wt %, B: 1 to 2 wt %, and Fe (electrolytic iron): 60 to 70 wt %. Furthermore, the permanent magnet 1 may include other elements such as Dy, Tb, Co, Cu, Al, Si, Ga, Nb, V, Pr, Mo, Zr, Ta, Ti, W, Ag, Bi, Zn or Mg in small amount, in order to improve the magnetic properties thereof. FIG. 1 is an overall view of the permanent magnet 1 according to the present embodiment.

The permanent magnet 1 as used herein is a thin film-like permanent magnet having a thickness of 0.05 to 10 mm (for instance, 1 mm), and is prepared by sintering a formed body (a green sheet) formed into a sheet-like shape from a mixture (a slurry or a powdery mixture) of magnet powder and a binder as described later.

In the present invention, resin, long-chain hydrocarbon or a mixture thereof is used as the binder to be mixed with the magnet powder.

Further, if the resin is used as the binder, there are preferably used polymers having no oxygen atoms in the structure and being depolymerizable. Specifically, an optimal polymer is a polymer or a copolymer of one or more kinds of monomers selected from monomers expressed with the following general formula (3):

[general formula 3]

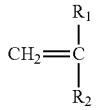

(3)

(wherein $R_1$ and $R_2$ each represent a hydrogen atom, a lower alkyl group, a phenyl group or a vinyl group).

Polymers that satisfy the above condition include: polyisobutylene (PIB) formed from isobutene polymerization, polyisoprene (isoprene rubber or IR) formed from isoprene polymerization, polybutadiene (butadiene rubber or BR) formed from butadiene polymerization, polystyrene formed from styrene polymerization, styrene-isoprene block copolymer (SIS) formed from copolymerization of styrene and isoprene, butyl rubber (IIR) formed from copolymerization of isobutylene and isoprene, styrene-butadiene block copolymer (SBS) formed from copolymerization of styrene and butadiene, Poly(2-methyl-1-pentene) formed from polymerization of 2-methyl-1-pentene, poly(2-methyl-1-butene) formed from polymerization of 2-methyl-1-butene, and poly (alpha-methylstyrene) formed from polymerization of alpha-methylstyrene. Incidentally, low molecular weight polyisobutylene is preferably added to the poly(alpha-methylstyrene) to produce flexibility. Further, resins to be used for the binder may include small amount of polymer or copolymer of monomers containing oxygen atoms (such as polybutylmethacrylate or polymethylmethacrylate). Further, monomers not satisfying the above general formula (3) may be partially copolymerized. Even in such a case, the purpose of this invention can be realized.

Incidentally, in a case slurry-molding is used for forming the green sheet, the binder is preferably made of a resin excluding polyethylene and polypropylene (in other words, excluding: a polymer of such monomers as having hydrogen atoms at both $R_1$ and $R_2$ of the general formula (3); and a polymer of such monomers as having a hydrogen atom at one of the $R_1$ and $R_2$ of the general formula (3) and a methyl group at the other of the $R_1$ and $R_2$). Meanwhile, in a case hot-melt molding is employed for forming the green sheet, a thermoplastic resin is preferably used for the convenience of performing magnetic field orientation using the formed green sheet in a heated and softened state.

Among the above-mentioned polymers, for instance, polyisobutylene is expressed by the following general formula (4):

[general formula 4]

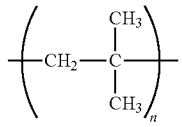

(4)

(wherein n represents a positive integer)

Further, among the above-mentioned polymers, for instance, polyisoprene is expressed by the following general formula (5):

[general formula 5]

$$-\left(CH_2-\overset{\overset{CH_3}{|}}{C}=CH-CH_2\right)_n- \quad (5)$$

(wherein n represents a positive integer).

Further, among the above-mentioned polymers, for instance, polybutadiene is expressed by the following general formula (6):

[general formula 6]

$$-(CH_2-CH=CH-CH_2)_n- \quad (6)$$

(wherein n represents a positive integer).

Meanwhile, in a case a long-chain hydrocarbon is used for the binder, there is preferably used a long-chain saturated hydrocarbon (long-chain alkane) being solid at room temperature and being liquid at a temperature higher than the room temperature. Specifically, a long-chain saturated hydrocarbon whose carbon number is 18 or more is preferably used. In the case of using the hot melt molding for forming the green sheet, the magnetic field orientation of the green sheet is performed in a state where the green sheet is heated to soften at a temperature higher than the melting point of the long-chain hydrocarbon.

Through using a binder that satisfies the above condition as binder to be mixed with the magnet powder when preparing the green sheet, the carbon content and oxygen content in the magnet can be reduced. Specifically, the carbon content remaining after sintering is made 1500 ppm or lower, or more preferably, 1000 ppm or lower. Further, the oxygen content remaining after sintering is made 5000 ppm or lower, or more preferably, 2000 ppm or lower.

Further, the amount of the binder to be added is an optimal amount to fill the gaps between magnet particles so that thickness accuracy of the sheet can be improved when forming the mixture of the magnet powder and the binder into a sheet-like shape. For instance, the binder proportion to the amount of magnet powder and binder in total in the slurry after the addition of the binder is preferably 1 wt % through 40 wt %, more preferably 2 wt % through 30 wt %, still more preferably 3 wt % through 20 wt %.

[Method for Manufacturing Permanent Magnet]

Figure 2:
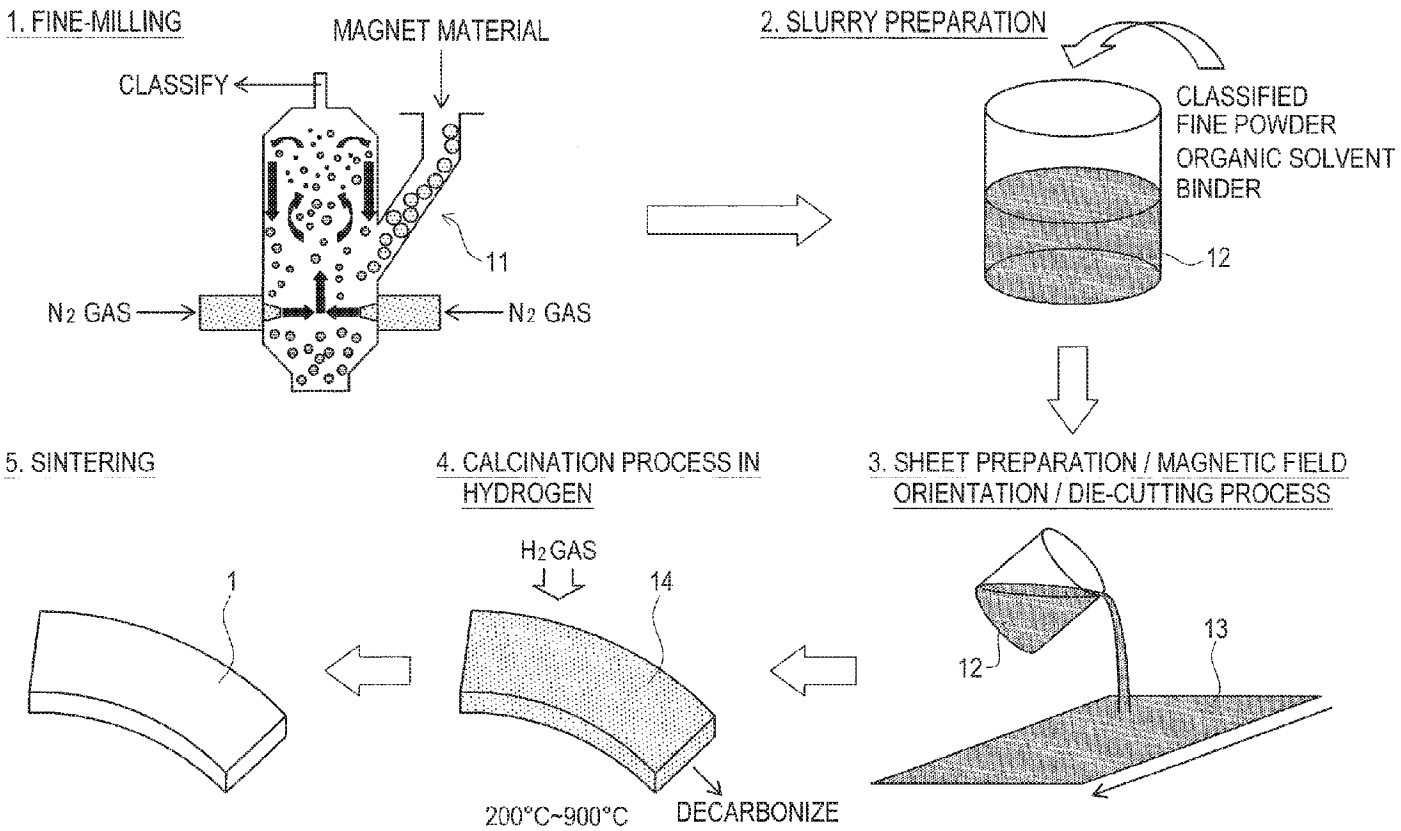
FIG. 2 is an explanatory diagram illustrating manufacturing processes of a permanent magnet according to the invention.

Next, a method for manufacturing the permanent magnet 1 according to the present invention will be described below with reference to FIG. 2. FIG. 2 is an explanatory view illustrating a manufacturing process of the permanent magnet 1 according to the present invention.

First, there is manufactured an ingot comprising Nd—Fe—B of certain fractions (for instance, Nd: 32.7 wt %, Fe (electrolytic iron): 65.96 wt %, and B: 1.34 wt %). Thereafter the ingot is coarsely milled using a stamp mill, a crusher, etc. to a size of approximately 200 μm. Otherwise, the ingot is dissolved, formed into flakes using a strip-casting method, and then coarsely milled using a hydrogen pulverization method.

Next, the coarsely milled magnet powder is finely milled with a jet mill 11 to form fine powder of which the average particle diameter is smaller than a predetermined size (for instance, 1.0 μm through 5.0 μm) in: (a) an atmosphere composed of inert gas such as nitrogen gas, argon (Ar) gas, helium (He) gas or the like having an oxygen content of substantially 0%; or (b) an atmosphere composed of inert gas such as nitrogen gas, Ar gas, He gas or the like having an oxygen content of 0.0001 through 0.5%. Here, the term "having an oxygen content of substantially 0%" is not limited to a case where the oxygen content is completely 0%, but may include a case where oxygen is contained in such an amount as to allow a slight formation of an oxide film on the surface of the fine powder. Incidentally, wet-milling may be employed for a method for milling the magnet material. For instance, in a wet method by a bead mill, using toluene as a solvent, coarsely milled magnet powder may be finely milled to a predetermined size (for instance, 0.1 μm through 5.0 μm). Thereafter, the magnet powder contained in the organic solvent after the wet milling may be desiccated by such a method as vacuum desiccation to obtain the desiccated magnet powder. There may be configured to add and knead the binder to the organic solvent after the wet milling without removing the magnet powder from the organic solvent to obtain later described slurry 12.

Through using the above wet-milling, the magnetic material can be milled into still smaller grain sizes than those in the dry-milling. However, if the wet-milling is employed, there rises a problem of residual organic compounds in the magnet due to the organic solvent, even if the later vacuum desiccation vaporizes the organic solvent. However, this problem can be solved by removing carbons from the magnet through performing the later-described calcination process to decompose the organic compounds remaining with the binder by heat.

Meanwhile, a binder solution is prepared for adding to the fine powder finely milled by the jet mill 11 or the like. Here, as mentioned above, there can be used a resin, a long-chain hydrocarbon or a mixture thereof as binder. For instance, when a resin is employed, it is preferable that the resin is made of a polymer or copolymer of monomers containing no oxygen atoms, and when a long-chain hydrocarbon is employed, it is preferable that a long-chain saturated hydrocarbon (long-chain alkane) is used. Then, binder solution is prepared through dissolving the binder into a solvent. The solvent to be used for dissolving is not specifically limited, and may include: alcohols such as isopropyl alcohol, ethanol and methanol; lower hydrocarbons such as pentane and hexane; aromatic series such as benzene, toluene and xylene; esters such as ethyl acetate; ketones; and a mixture thereof. However, toluene or ethyl acetate is used here.

Successively, the above binder solution is added to the fine powder classified at the jet mill 11. Through this, slurry 12 in which the fine powder of magnet raw material, the binder and the organic solvent are mixed is prepared. Here, the amount of binder solution to be added is preferably such that binder proportion to the amount of magnet powder and binder in total in the slurry after the addition is 1 wt % through 40 wt %, more preferably 2 wt % through 30 wt %, still more preferably 3 wt % through 20 wt %. For instance, 100 grams of 20 wt % binder solution is added to 100 grams of the magnet powder to prepare the slurry 12. Here, the addition of the binder solution is performed in an atmosphere composed of inert gas such as nitrogen gas, Ar gas or He gas.

Subsequently, a green sheet 13 is formed from the slurry 12 thus produced. The green sheet 13 may be formed by, for instance, a coating method in which the produced slurry 12 is spread on a supporting substrate such as a separator as needed by an optimal system and then desiccated. Incidentally, the coating method is preferably a method excellent in layer thickness controllability, such as a doctor blade system or a slot-die system. Further, a defoaming agent may preferably be used in conjunction therewith to sufficiently perform defoaming treatment so that no air bubbles remain in a spread layer. Incidentally, detailed coating conditions are as follows:

Coating method: doctor blade or die system

Gap: 1 mm

Supporting substrate: silicone-treated polyester film

Drying condition: 130 deg. C.*30 min after 90 deg. C.*10 min

Incidentally, a preset thickness of the green sheet 13 is desirably within a range of 0.05 mm through 10 mm. If the thickness is set to be thinner than 0.05 mm, it becomes necessary to accumulate many layers, which reduces the productivity. Meanwhile, if the thickness is set to be thicker than 10 mm, it becomes necessary to decrease the drying rate so as to inhibit air bubbles from forming at drying, which significantly lowers the productivity.

Further, when mixing the magnet powder with the binder, the mixture may be made into not the slurry 12, but a mixture in the form of powder (hereinafter referred to as a powdery mixture) made of the magnet powder and the binder without adding the organic solvent. There may be employed hot melt coating in which the powdery mixture is heated to melt, and turns into a fluid state and then is spread onto the supporting substrate such as the separator. The mixture spread by the hot melt coating is left to cool and solidify, so that the green sheet 13 can be formed in a long sheet fashion on the supporting substrate. Incidentally, the temperature for heating and melting the powdery mixture differs depending on the kind or amount of binder to be used, but is set here at 50 through 300 degrees Celsius. However, it is necessary to set the temperature higher than the melting point of the binder to be used. Here, in order to mix the magnet powder and the binder together, the magnet powder and the binder are, for instance, respectively put into an organic solvent and stirred with a stirrer. After stirring, the organic solvent containing the magnet powder and the binder is heated to vaporize the organic solvent, so that the powdery mixture is extracted. Further, specifically when the magnet powder is milled by a wet method, there may be employed a configuration in which, without isolating the magnet powder out of an organic solvent used for the milling, the binder is added to the organic solvent and kneaded, and thereafter the organic solvent is vaporized to obtain the powdery mixture.

Further, a pulsed field is applied before drying to the green sheet 13 coated on the supporting substrate, in a direction intersecting a transfer direction. The intensity of the applied magnetic field is 5000 [Oe] through 150000 [Oe], or preferably 10000 [Oe] through 120000 [Oe]. Incidentally, the direction to orient the magnetic field needs to be determined taking into consideration the magnetic field direction required for the permanent magnet 1 formed from the green sheet 13, but is preferably in-plane direction. Incidentally, if the green sheet is formed by the hot melt molding, the magnetic field orientation of the green sheet is performed in a state where the green sheet is heated to soften in a temperature above the glass transition point or the melting point of the binder. Further, the magnetic field orientation may be performed before the formed green sheet has congealed.

Then, the green sheet 13 is die-cut into a desired product shape (for example, the fan-like shape shown in FIG. 1) to form a formed body 14.

Thereafter, the formed body 14 thus formed is held at a binder-decomposition temperature for several hours (for instance, five hours) in a non-oxidizing atmosphere (specifically in this invention, a hydrogen atmosphere or a mixed gas atmosphere of hydrogen and inert gas) and a calcination process in hydrogen is performed. The hydrogen feed rate during the calcination is, for instance, 5 L/min, if the calcination is performed in the hydrogen atmosphere. By the calcination process in hydrogen, the binder can be decomposed into monomers through depolymerization reaction, released therefrom and removed. Namely, so-called decarbonization is performed in which carbon content in the formed body 14 is reduced. Furthermore, calcination process in hydrogen is to be performed under such a condition that carbon content in the formed body 14 is 1500 ppm or lower, or more preferably 1000 ppm or lower. Accordingly, it becomes possible to densely sinter the permanent magnet 1 as a whole in the following sintering process, and the decrease in the residual magnetic flux density or in the coercive force can be prevented.

The binder-decomposition temperature is determined based on the analysis of the binder decomposition products and decomposition residues. In particular, the temperature range to be selected is such that, when the binder decomposition products are trapped, no decomposition products except monomers are detected, and when the residues are analyzed, no products due to the side reaction of remnant binder components are detected. The temperature differs depending on the type of binder, but may be set at 200 through 900 degrees Celsius, or more preferably 400 through 600 degrees Celsius (for instance, 600 degrees Celsius). Further, in a case the magnet raw material is milled in an organic solvent by wet-milling, the calcination process is performed at a decomposition temperature of the organic compound composing the organic solvent as well as the binder decomposition temperature. Accordingly, it is also made possible to remove the residual organic solvent. The decomposition temperature for an organic compound is determined based on the type of organic solvent to be used, but basically the organic compound can be thermally decomposed in the above binder decomposition temperature.

Thereafter, a sintering process is performed in which the formed body 14 calcined in the calcination process in hydrogen is sintered. When the sintering is performed, the temperature is raised to approximately 800 through 1200 degrees Celsius in a given rate of temperature increase and held for approximately two hours. During this period, vacuum sintering is performed, and the degree of vacuum is preferably equal to or smaller than $10^{-4}$ Torr. The formed body 14 is then cooled down, and again undergoes a heat treatment in 600 through 1000 degrees Celsius for two hours. As a result of the sintering, the permanent magnet 1 is manufactured.

Meanwhile, pressure sintering may be employed instead of the vacuum sintering. The pressure sintering includes, for instance, hot pressing, hot isostatic pressing (HIP), high pressure synthesis, gas pressure sintering, and spark plasma sintering (SPS) and the like. The pressure sintering enables lower sintering temperature and curbed grain growth at sintering. As a result, magnetic performance can be improved further.

EMBODIMENTS

Here will be described on embodiments according to the present invention referring to comparative examples for comparison.

Embodiment 1

In Embodiment 1, there is used a Nd—Fe—B-based magnet and alloy composition thereof is Nd/Fe/B=32.7/65.96/1.34 in wt %. Polyisobutylene as binder and toluene as solvent have been used to prepare a binder solvent. 100 grams of binder solvent containing 20 wt % of binder has been added to 100 grams of magnet powder so as to obtain slurry in which the proportion of the binder is 16.7 wt % with reference to the total weight of the magnet powder and the binder in the slurry. After that, the thus obtained slurry has been applied onto a substrate by means of a [die ] system for forming a green sheet and the thus obtained green sheet has been die-cut into a desired shape for product. Further, a calcination process has been performed by holding the die-cut green sheet for five hours in a hydrogen atmosphere at 600 degrees Celsius. The hydrogen feed rate during the calcination is 5 L/min. Other processes are the same as the processes in [Method for Manufacturing Permanent Magnet] mentioned above.

Embodiment 2

Polyisoprene (IR) has been used as binder to be mixed. Other conditions are the same as the conditions in embodiment 1.

Embodiment 3

Polybutadiene (BR) has been used as binder to be mixed. Other conditions are the same as the conditions in embodiment 1.

Embodiment 4

Polystyrene has been used as binder to be mixed. Other conditions are the same as the conditions in embodiment 1.

Embodiment 5

A styrene-isoprene copolymer (SIS) has been used as binder to be mixed. Other conditions are the same as the conditions in embodiment 1.

Embodiment 6

An isobutylene-isoprene copolymer (IIR) has been used as binder to be mixed. Other conditions are the same as the conditions in embodiment 1.

Embodiment 7

A styrene-butadiene copolymer (SBS) has been used as binder to be mixed. Other conditions are the same as the conditions in embodiment 1.

Embodiment 8

Poly(2-methyl-1-pentene) has been used as binder to be mixed. Other conditions are the same as the conditions in embodiment 1.

Embodiment 9

Poly(2-methyl-1-butene) has been used as binder to be mixed. Other conditions are the same as the conditions in embodiment 1.

Embodiment 10

Poly(alpha-methylstyrene) has been used as binder to be mixed and low molecular weight polyisobutylene has been added for plasticity. Other conditions are the same as the conditions in embodiment 1.

Embodiment 11

Octacosane, a kind of long-chain alkane, has been used as binder to be mixed. Other conditions are the same as the conditions in embodiment 1.

Comparative Example 1

Polybutylmethacrylate has been used as binder to be mixed. Other conditions are the same as the conditions in embodiment 1.

Comparative Example 2

Polymethylmethacrylate has been used as binder to be mixed. Other conditions are the same as the conditions in embodiment 1.

Comparative Example 3

Polyethylene has been used as binder to be mixed. Other conditions are the same as the conditions in embodiment 1.

Comparative Example 4

Polypropylene has been used as binder to be mixed. Other conditions are the same as the conditions in embodiment 1.

Comparative Example 5

A permanent magnet has been manufactured without hydrogen calcination process. Other conditions are the same as the conditions in embodiment 1.

Comparison of Embodiments with Comparative Examples

There have been measured oxygen concentration [ppm] and carbon concentration [ppm] remaining in respective magnets of embodiments 1 through 11 and comparative examples 1, 2 and 5. Further, there has been evaluated formability to form a green sheet from slurry regarding the embodiments 1 through 11 and the comparative examples 1 through 5. Further, there have been measured residual magnetic flux density [kG] and coercive force [kOe] regarding the embodiments 1 through 11 and the comparative examples 1, 2 and 5. FIG. 3 shows measurement results regarding respective embodiments and comparative examples.

It is apparent from FIG. 3 that oxygen content remaining in the magnet can be reduced significantly in cases of using binders having no oxygen atoms, such as polyisobutylene, polyisoprene, polybutadiene, polystyrene, a styrene-isoprene copolymer (SIS), an isobutylene-isoprene copolymer (IIR), a styrene-butadiene copolymer (SBS), poly(2-methyl-1-pentene), poly(2-methyl-1-butene), poly(alpha-metylstyrene) and octacosane, in comparison with cases of using binders having oxygen atoms such as polybutylmethacrylate and polymethylmethacrylate. Specifically, oxygen content remaining in the sintered magnet can be reduced to 5000 ppm or lower, more specifically, 2000 ppm or lower. Consequently, such low oxygen content can prevent Nd from binding to oxygen to form a Nd oxide and also prevent alpha iron from separating out. Accordingly, as shown in FIG. 3, high values of residual magnetic flux density and those of coercive force can be obtained in cases of using polyisobutylene and the like as binders.

Further, as shown in FIG. 3, it is apparent that carbon content contained in the magnet can be reduced significantly in a case of performing a hydrogen calcination process in comparison with a case of not performing a hydrogen calcinations process. Further, owing to the hydrogen calcination process, carbon content remaining in the sintered magnet is reduced to 1500 ppm or lower, more specifically, 1000 ppm or lower except for the embodiment 2. Consequently, the entirety of the magnet can be sintered densely without making a gap between a main phase and a grain boundary phase. Further, decrease in the residual magnetic flux density can be prevented.

Further, as shown in FIG. 3, in case of using polyethylene or polypropylene as binder, the binder hardly gets dissolved in a general purpose solvent such as toluene or the like. Therefore, it has been difficult to properly form a green sheet from slurry containing the above specified binder. Contrarily, in case of using polyisobutylene or the like as binder, the binder gets dissolved in a general purpose solvent such as toluene. Therefore, a green sheet can be formed from slurry containing the binder made of polyisobutylene or the like.

As described, according to the permanent magnet 1 and the manufacturing method of the permanent magnet 1 directed to the afore-mentioned embodiments, magnet material is milled into magnet powder, the thus obtained magnet powder and a binder are mixed to form a mixture (slurry, powdery mixture, etc.), the binder being any one of three kinds of binders: a binder made of a long-chain hydrocarbon; a binder made of a polymer or a copolymer consisting of one or more kinds of monomers selectable from possible monomers expressed with the general formula (3) ($R_1$ and $R_2$ in the general formula (3) represent a hydrogen atom, a lower alkyl group, a phenyl group or a vinyl group); or a binder obtained by mixing the long-chain hydrocarbon and either the polymer or the copolymer mentioned in the above. After that, the thus obtained mixture is formed into a sheet-like shape so as to obtain a green sheet. After that, the thus obtained green sheet is held for a predetermined length of time at binder decomposition temperature in a non-oxidizing atmosphere so as to remove the binder by causing depolymerization reaction or the like to the binder, which eventually changes into monomer. The green sheet from which the binder has been removed is sintered by raising temperature up to sintering temperature so as to complete the permanent magnet 1. Consequently, the thus sintered green sheet uniformly contracts and deformations such as warpage and depressions do not occur to the sintered green sheet. Further, the sintered green sheet having uniformly contracted gets pressed uniformly, which eliminates adjustment process to be conventionally performed after sintering and simplifies manufacturing process. Thereby, a permanent magnet can be manufactured with high dimensional accuracy. Further, even if such permanent magnets are manufactured with thinner design, increase in the number of manufacturing processes can be avoided without lowering a material yield. Further, oxygen content remaining in the sintered magnet can be reduced by using a binder made of a long-chain hydrocarbon or a binder made of a polymer or a copolymer consisting of monomers containing no oxygen atoms. Particularly, oxygen content in the sintered magnet can be reduced by using binders containing no oxygen atoms, such as polyisobutylene, polyisoprene, polybutadiene, polystyrene, a styrene-isoprene copolymer, an isobutylene-isoprene copolymer and a styrene-butadiene copolymer. Further, magnet powder to which the binder has been added is calcined for a predetermined length of time under a non-oxidizing atmosphere so as to decompose and remove the binder before sintering, whereby carbon content in the permanent magnet can be reduced previously. Consequently, previous reduction of carbon can prevent alpha iron from separating out in a main phase of the sintered magnet and the entirety of the magnet can be sintered densely. Thereby, decrease in the coercive force can be prevented. Further, resin other than polyethylene resin and polypropylene resin (e.g., polyisobutylene, polyisoprene, polybutadiene, polystyrene, a styrene-isoprene copolymer, an isobutylene-isoprene copolymer and a styrene-butadiene copolymer) are as binder so that the above binders can get dissolved in a general purpose solvent such as toluene. Consequently, a green sheet can be formed properly from slurry containing any of the above binders.

Further, in the calcination process, the green sheet to which the binder has been mixed is held for the predetermined length of time at temperature range of 200 degrees Celsius to 900 degrees Celsius in a hydrogen atmosphere or a mixed gas atmosphere of hydrogen and inert gas. Thereby, carbon content in the magnet can be reduced reliably.

Not to mention, the present invention is not limited to the above-described embodiments but may be variously improved and modified without departing from the scope of the present invention.

Further, of magnet powder, milling condition, mixing condition, calcination condition, sintering condition, etc. are not restricted to conditions described in the embodiments. For instance, in the above described embodiments, magnet material is dry-milled by using a jet mill. Alternatively, magnet material may be wet-milled by using a bead mill. In the above-mentioned embodiments, the green sheet is formed in accordance with a slot-die system. However, a green sheet may be formed in accordance with other system or molding such as calendar roll system, comma coating system, extruding system, injection molding, doctor blade system, etc., as long as it is the system that is capable of forming slurry or fluid-state powdery mixture into a green sheet on a substrate at high accuracy.

Further, the calcination process may be omitted. Even so, the binder is thermally decomposed during the sintering process and certain extent of decarbonization effect can be expected. Alternatively, the calcination process may be performed in an atmosphere other than hydrogen atmosphere.

Description of the present invention has been given by taking the example of the Nd—Fe—B-based magnet. However, magnet made of other kinds of material (for instance, cobalt magnet, alnico magnet, ferrite magnet, etc.) may be used. Further, in the embodiments of present invention, the proportion of Nd component ratio with reference to the alloy composition of the magnet is set higher in comparison with Nd component ratio in accordance with the stoichiometric composition. The proportion of Nd component may be set the same as the alloy composition according to the stoichiometric composition.

DESCRIPTION OF REFERENCE NUMERALS AND SIGNS

1 permanent magnet
11 jet mill
12 slurry
13 green sheet
14 formed body

The invention claimed is:

1. A manufacturing method of a rare-earth permanent magnet comprising steps of:

milling magnet material into magnet powder;

forming a mixture by mixing the magnet powder and any one of three kinds of binders a binder made of a long-chain hydrocarbon or a binder made of a polymer or a copolymer consisting of one or more kinds of monomers selectable from possible monomers expressed with a general formula (1)

[general formula 1]

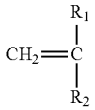

(1)

($R_1$ and $R_2$ represent a hydrogen atom, a lower alkyl group, a phenyl group or a vinyl group)

or a binder obtained by mixing the long-chain hydrocarbon and either the polymer or the copolymer;

obtaining a green sheet by forming the mixture into a sheet-like shape; the mixture is formed by employing hot melt coating in which the mixture is heated to melt, and turns into a fluid state and then is spread;

removing the binder by holding the green sheet for a predetermined length of time at binder decomposition temperature in a non-oxidizing atmosphere; and sintering the green sheet from which the binder has been removed by raising temperature up to sintering temperature.

2. The manufacturing method of rare-earth permanent magnet according to claim 1, wherein the binder is any one of: polyisobutylene; polyisoprene; polybutadiene; polystyrene; a styrene-isoprene copolymer; an isobutylene-isoprene copolymer; and a styrene-butadiene copolymer.

3. The manufacturing method of a rare-earth permanent magnet according to claim 1, wherein, in the step of removing the binder, the green sheet is held for the predetermined length of time at temperature range of 200 degrees Celsius to 900 degrees Celsius in a hydrogen atmosphere or a mixed gas atmosphere of hydrogen and inert gas.

* * * * *